US006650291B1

(12) United States Patent
West et al.

(10) Patent No.: US 6,650,291 B1
(45) Date of Patent: Nov. 18, 2003

(54) MULTIBAND PHASED ARRAY ANTENNA UTILIZING A UNIT CELL

(75) Inventors: James B. West, Cedar Rapids, IA (US); Mohamed Wajih A. Elsallal, Hiawatha, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 10/141,269

(22) Filed: May 8, 2002

(51) Int. Cl.[7] ..... H01Q 3/26
(52) U.S. Cl. ..... 342/371
(58) Field of Search ..... 342/368–384

(56) References Cited

U.S. PATENT DOCUMENTS

| | | | |
|---|---|---|---|
| 5,736,908 | A | 4/1998 | Alexanian et al. |
| 6,281,838 | B1 | 8/2001 | Hong |
| 6,483,480 | B1 | 11/2002 | Sievenpiper |

OTHER PUBLICATIONS

Endfire slot antennas Stephenson, B.; Walter, C. Antennas and Propagation, IEEE Transactions on [legacy, pre—1988], vol. 3, Iss. 2, Apr. 1955.*

A dual band phased array using interleaved waveguides and dipoles printed on high dielectric substrate Kuan Lee; Clark, J.; Ruey Chu; Nam Wong; Tang, R.; Antennas and Propagation Society International Symposium, 1984, vol.: 22, Jun. 1984.*

Analysis and design of a multi–band phased array using multi–feed dipole elements Chu, R.S.; Lee, K.M.; Wang, A.; Antennas and Propagation Society International Symposium, 1995. AP–S. Digest , vol.: 4 , Jun. 18–23, 1995.*

Multiband phased–array antenna with interleaved tapered–elements and waveguide radiators Ruey–Shi Chu; Kuan Min Lee; Wang, A.T.S.; Antennas and Propagation Society International Symposium, 1996. AP–S, Digest , vol.: 3 , Jul. 21–26, 1996.*

Wide–band phased arrays of Vivaldi notch antennas Schaubert, D.H.; Antennas and Propagation, Tenth International Conference on (Conf. Publ. No. 436), vol.: 1, Apr. 14–17, 1997.*

A uniplanar quasi–Yagi antenna with wide bandwidth and low mutual coupling characteristics Yongxi Qian; Deal, W.R.; Kaneda, N.; Itoh, T. Antennas and Propagation Society, 1999. IEEE International Symposium 1999, vol. 2, Iss., Aug. 1999.*

A beam–steerer using reconfigurable PBG ground plane Elamaran, B.; Iao–Mak Chio; Liang–Yu Chen; Jung–Chih Chiao; Microwave Symposium Digest., 2000 IEEE MTT–S International, vol.: 2, 2000.*

(List continued on next page.)

*Primary Examiner*—Thomas H. Tarcza
*Assistant Examiner*—Fred H Mull
(74) *Attorney, Agent, or Firm*—Nathan O. Jensen; Kyle Eppele

(57) ABSTRACT

A multi-band phased array antenna for radiating low frequency band signals and high frequency band signals. The multiband phased array antenna is formed from unit cells having waveguides for radiating high frequency band signals and end-fire radiating elements for radiating low frequency band signals. The unit cells have four walls with an open input end and an open radiating end. End-fire radiating elements are disposed on inner surfaces and outer surfaces of the four walls and radiate out the radiating end. Four waveguides are disposed together to radiate into the input end of the low frequency assembly.

20 Claims, 9 Drawing Sheets

OTHER PUBLICATIONS

Active Microstrip Array Antennas, Chin Liong Yeo Bachelor of Engineering (Honours) Thesis, The University of Queensland, p. 34, 39–40, Oct. 2000 http://innovexpo.itee.uq.edu.au/2000/820533997/Thesis.pdf.*

MEMS–RF devices for antenna applications Jung–Chih Chiao; Microwave Conference, 2000 Asia–Pacific, Page(s): 895–898, 2000.*

Antenna and phased array implementations using engineered substrates Shafai, L.; Shafai, C.; Daneshmand, M.; Bugyik, P.L.; Aerospace Conference Proceedings, 2002. IEEE , vol. 2, Page(s): 2–873, 2002.*

"A Novel TEM Waveguide Using Uniplanar Compact Photonic Bandgap Structure" by F. Yang et al. IEEE Transactions on Microwave Theory and Techniques vol. 47 No. 11, Nov., 1999, pp. 2092–2098.

"The Application of Photonic Crystals to Quasi–Optic Amplifiers", by J. Higgins et al., IEEE Transactions on Microwave Theory and Techniques, vol. 47, No. 11, Nov. 1999, pp 2139–2143.

"A Rectangular TEM Waveguide with Photonic Crystal Walls for Excitation of Quasi–Optical Amplifiers", by M. Kim et al., Session TU3B–2 Tech Digest of 1999 IEEE Microwave Symposium, Anaheim, CA, May 1999.

"Characteristics of Ka Band Waveguide Using Electromagnetic Crystal Sidewalls", by J. A. Higgins et al., 2002 IEEE MTT–S International Microwave Symposium, Seattle, WA, Jun. 2002.

"A Uniplanar Quasi–Yagi Antenna with Wide Bandwidth and Low Mutual Coupling Characteristics", by Yongxi Qian et al. IEEE Antennas and Propagation Society 1999 AP–S International Symposium Digest, Orlando FL, Jul., 1999.

"Wideband Vivaldi Arrays for Large Aperture Antennas", by Daniel H. Schaubert et al. from Perspectives on Radio Astronomy—Technology for Large Antenna Arrays, Netherlands Foundation for Research in Astronomy, 1999.

*Electromagnetic Waves,* S. A. Schelkunoff, D. Van Norstrand Co., Inc, NY, NY 1943, pp. 392–397.

"Experimental Results of 144–Element Dual–Polarized Endfire Tapered–Slot Phased Arrays", Henrik Holter et al., IEEE Transactions on Antennas and Propagation, vol. 48, No. 11, Nov. 2000.

"Endfire Tapered Slot Antennas on Dielectric Substrates", by K. Sigfrid Yngvesson, et al., IEEE Transactions on Antennas and Propagation, vol. AP–33, No. 12, Dec. 1985.

* cited by examiner

MULTIBAND PHASED ARRAY ANTENNA UTILIZING A UNIT CELL

BACKGROUND OF THE INVENTION

This invention relates to antennas, phased array antennas, and more specifically to a multi-band phased array antenna.

Satellite communications (SATCOM) systems have been in use for many years for military and commercial applications. New SATCOM systems are requiring multiband operation with both planar and conformal arrays. Specific bands of current military interest include K band GBS (Global Broadcast System)(20 GHz), K/Ka band Wideband Gapfiller (20/30 GHz) and K/Q band MILSTAR/Advanced EHF (20/44 GHz). Commercial SATCOM systems and bands include such systems as Teledesic 29-GHz uplink/19-GHz downlink and Astrolink with 20-GHz downlink/30-GHz uplink.

Military and commercial SATCOM systems require continual connectivity communications for on-the-move vehicles on all frequency bands. This requires a directional lightweight steerable antenna for vehicular mounting. Wide area scan volume coverage and simultaneous beam operation with slaved transmit to receive beams are also required. Circular polarization (CP) is also required by SATCOM systems. LPI/LPD (low probability of interception/low probability of detection) and A/J (antijam) are needed features in military SATCOM systems. A desirable feature in a SATCOM antenna is the ability to provide a beam in the direction of a SATCOM satellite while placing a null in the direction of a potential interfering satellite or a jammer signal.

Previous attempts to solve these SATCOM antenna problems have included passive interlaced arrays where two antenna arrays of some type on different bands are built together or interlaced to reduce size. Interlaced arrays are limited in the number bands of operation and three and four band operation needed for current SATCOM applications is difficult to obtain. Antennas employing reflector technology such parabolic reflectors are difficult to implement in multiple bands. Furthermore, such antennas typically have slow mechanical beam scanning making it difficult to track a communications satellite in a rapidly maneuvering vehicle. Lens antennas are difficult to implement in multiband designs. A three or more band configuration requires different focal points.

A phased array antenna is a beam forming antenna in which the relative phases of the respective signals feeding the antennas are varied such that the effective radiation pattern of the phased array is reinforced in a desired direction and suppressed in undesired directions. The relative amplitudes of constructive and destructive interference effects among the signals radiated by the individual antennas determine the effective radiation pattern of the phased array. A phased array may be used to rapidly electronically scan in azimuth or elevation. Previous phased arrays have been limited in bandwidth. Ultra broadband radiating elements in conventional phased array antennas initiate grating lobes. Efficient broadband radiating elements tend to be large thereby making the entire array too large for many applications. Excessively large radiating element size forces a wide element-to-element spacing within an array, which generates grating lobes at the high end of the bandwidth. Millimeter wave beam steering control and bias distribution networks tend to be very complicated in current phased array antennas. Power generation losses and noise figure corruption occurs due to interconnect losses in conventional phased arrays.

A need exists for a cost effective, lightweight multi-band directional satellite communication antenna based on phased array technology.

SUMMARY OF THE INVENTION

A multiband phased array antenna for transmitting and receiving low frequency band signals and high frequency band signals is disclosed. The phased array antenna is assembled from a sub-array of unit cells with the unit cells adjacent to each other. Each unit cell further comprises four walls disposed in a square configuration with parallel pairs of walls and with an open input end and an open radiating end. End-fire radiating elements are located on inner surfaces and on outer surfaces of the four walls for radiating and receiving low frequency band signals out the radiating end. The outer surface end-fire radiating elements serve as inner surface radiating elements for adjacent unit cells. The end-fire radiating elements may be quasi-Yagi radiators or notch radiators such as antipodal notches or Vivaldi notches. Horizontal end-fire radiating elements are disposed on horizontal inner walls to produce a horizontal polarized signal and vertical end-fire radiating elements are disposed on the vertical inner walls to produce a vertical polarized signal. The vertical end-fire radiating elements and the horizontal end-fire radiating elements may be fed in phase quadrature to produce a circular polarized signal.

The unit cell further comprises four or more waveguide radiating elements disposed together in a square configuration. The waveguide radiating elements have open ends for radiating and receiving high frequency band signals through the four walls of the low frequency band radiating elements. The waveguide radiating elements may comprise pairs of triangular waveguides disposed together to form a single square shaped dual band waveguide. The sidewalls of a waveguide may be covered with photonic band gap material to lower the waveguide cutoff frequency.

A plurality of phase shifters are connected to unit cells to shift the phase of the low frequency band signals and the high frequency band signals to steer a beam of the phased array antenna. The phase shifters may comprise MEMS switch-based true time delay phase shifters connected between an RF signal source and the end-fire radiating elements for phase shifting the low frequency signals. The phase shifters may comprise a tunable photonic band gap material in the waveguide radiating element for phase shifting the high frequency signals.

It is an object of the present invention to provide an antenna with multiband operation for commercial and military SATCOM and other applications.

It is an object of the present invention to provide a directional antenna to provide continual communications for rapidly maneuvering vehicles.

It is an advantage of the present invention to provide a phased array antenna having a modular unit cell.

It is an advantage of the present invention to provide an antenna having a compact unit cell with multiband operation.

It is a feature of the present invention to provide simplified phase shifting methods to steer the phased array beam It is a feature of the present invention to provide a simplified feed system to feed the multiband phased array antenna.

BRIEF DESCRIPTION OF THE DRAWINGS

The invention may be more fully understood by reading the following description of the preferred embodiments of the invention in conjunction with the appended drawings wherein.

DETAILED DESCRIPTION

Figures 1A, 1B, 1C:
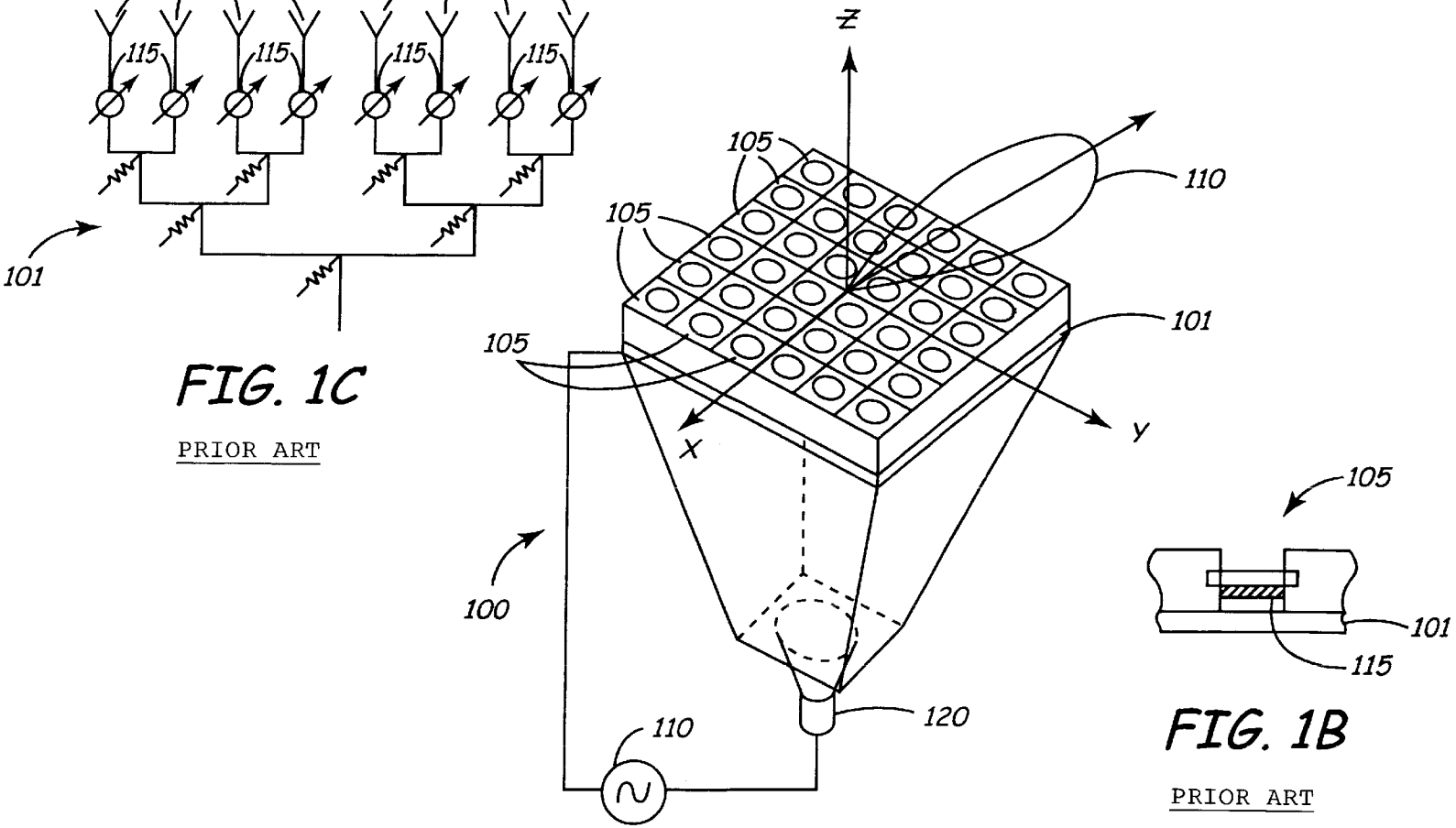
FIG. 1A PRIOR ART
FIG. 1B PRIOR ART
FIG. 1C PRIOR ART
FIG. 1*a* is a drawing of typical phased array antenna known in the art.
FIG. 1*b* is a drawing of an antenna element forming the phased array of FIG. 1*a;*
FIG. 1*c* is an electrical schematic of a constrained feed for the phased array antenna of FIG. 1*a;*

A typical phased array antenna 100 known in the art is shown in FIG. 1*a*. The phased array antenna 100 consists of an array of antenna elements 105 radiating in phase coherence. The antenna elements 105 may be of any suitable type known in the art but typically are apertures such as slots, circular apertures or open-ended waveguides. The radiation pattern 110 of the phased array antenna 100 may be steered by shifting the phase of adjacent elements 105 in the array. The array of apertures 105 may be driven by a space feed using a horn 120 or a constrained transmission line feed manifold 101 from an RF signal source 110. Although both space feed horn 120 and a constrained feed manifold 101 are shown in FIG. 1*a*, it is understood that only one is used at time. The feed manifold 101 consists of a power splitting network to distribute power to the antenna elements 105. A passive phase shifter 115 in FIG. 1*b* may be used to shift the phase in each antenna element to achieve steering of the radiation pattern 110. An electrical schematic of a portion of a phased array antenna 100 is shown in FIG. 1*c*. FIG. 1*c* shows the power splitting network of the feed manifold 101 connected to the phase shifters 115 and then to the antenna elements 105. A phased array antenna 100 such as that shown in FIG. 1*a* is typically optimized for narrow band operation.

Figure 2B:
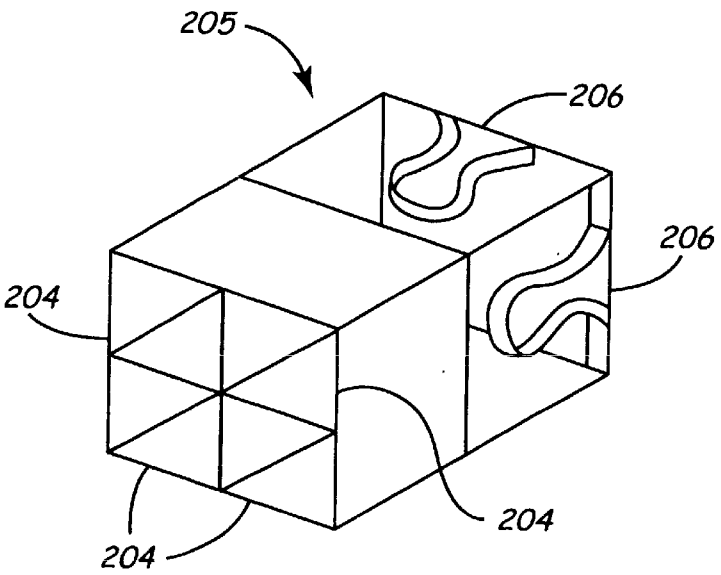
FIG. 2*b* is a drawing of unit cell used to form the multiband phased array antenna of the present invention.
Figure 2A:
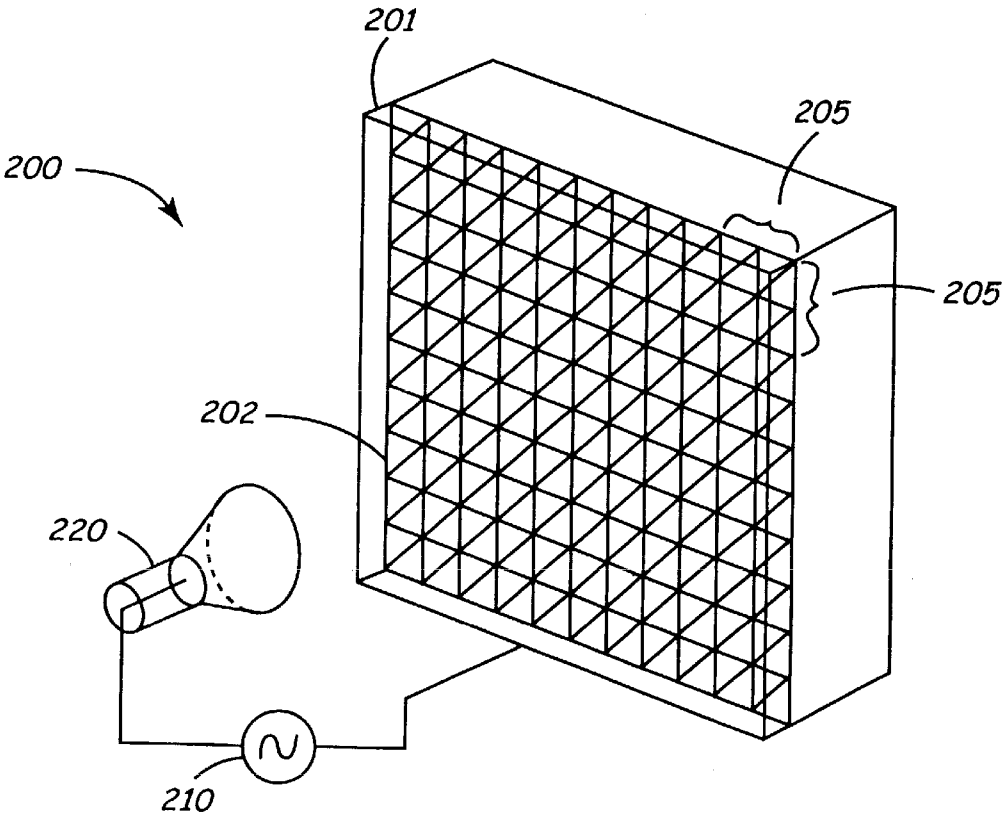
FIG. 2*a* is a drawing of a multiband phased array antenna of the present invention.

A multiband phased array antenna 200 of the present invention is show in FIG. 2*a*. The multiband phased array antenna 200 may be implemented by integrating several radiating elements 204 and 206 that cover the desired SATCOM frequency bands into a unit cell 205 as shown in FIG. 2*b*, combining unit cells into a sub-array, and combining sub-arrays to assemble electrically large phased array panel 202. Unit cells 205 may form a basis of a piecewise planar approximation to a compound curved conformal array (non-planar).

A space feed may be used to drive the unit cells 205. RF signal source 210 provides signals to a feed horn 220 to drive the unit cells 205 in the array in a fashion similar to that shown in FIG. 1*a*. The RF signal source 210 may also provide signals to a constrained feed manifold 201 containing a power splitting network similar to that shown in FIG. 1*c* to feed the unit cells 205. The multiband phased array antenna 200 of the present invention is shown in FIG. 2*a* as a transmit antenna connected to RF signal source 210. The phased array antenna 200 may be used as a receive antenna for receiving SATCOM signals by substituting a receiver for the RF source 210.

The table below summarizes various SATCOM bands and frequencies in exemplary fashion at which the phased array antenna 200 of the present invention may be used. Other bands and combination of bands are possible with the phased array antenna 200 of the present invention. Various radiating elements 204 and 206 that may be integrated together in unit cells 205 and sub-arrays to realize multiband operation in the present invention are also shown in the table. For example, radiating element 204 may be a passive waveguide or a spatial combiner waveguide. Radiating element 206 may be a printed end-fire radiating element such as a Yagi, dipole, notch, or slot antenna. Examples of printed dipoles include a single dipole. A single monopole may also be used. Examples of notch radiating elements include a Vivaldi notch, antipodal notch, tapered notch, balanced antipodal slotline, and a stripline notch. Slot antennas that be used include an antipodal slotline, a tapered slot, an exponential tapered slot, a stepped approximation to a tapered slot, a linearly tapered slot antenna (LTSA), a constant width slot antenna (CWSA), and a MIC slot line antenna. A dielectric rod antenna that is not a planar or printed end fire antenna may be used by attaching to walls of the unit cell 205.

Phase shifting to steer the beam of the antenna 200 may be provided by a true time delay (TTD) device phase shifter for the low frequency bands and as part of the waveguide elements 204 as summarized in the table and described in detail in the following paragraphs.

| Frequency | Radiating Element | Phase Shifter |
|---|---|---|
| Low Frequency: 11/12-GHz band, 20-GHz Milstar receive band | Horizontal/vertical printed end-fire element pairs phased for CP. Yagi, dipole, notch, slot | MEMS switched line TTD, MMIC T/R active circuitry Tunable PBG |
| High Frequency: 30-GHz Gapfiller GBS, 44-GHz Adv. EHF | PHEMT amplifier based Spatial Power Combiner waveguide, Passive waveguide, phase shifter assemblies | Tunable PBG waveguide wall |

Figure 3A:
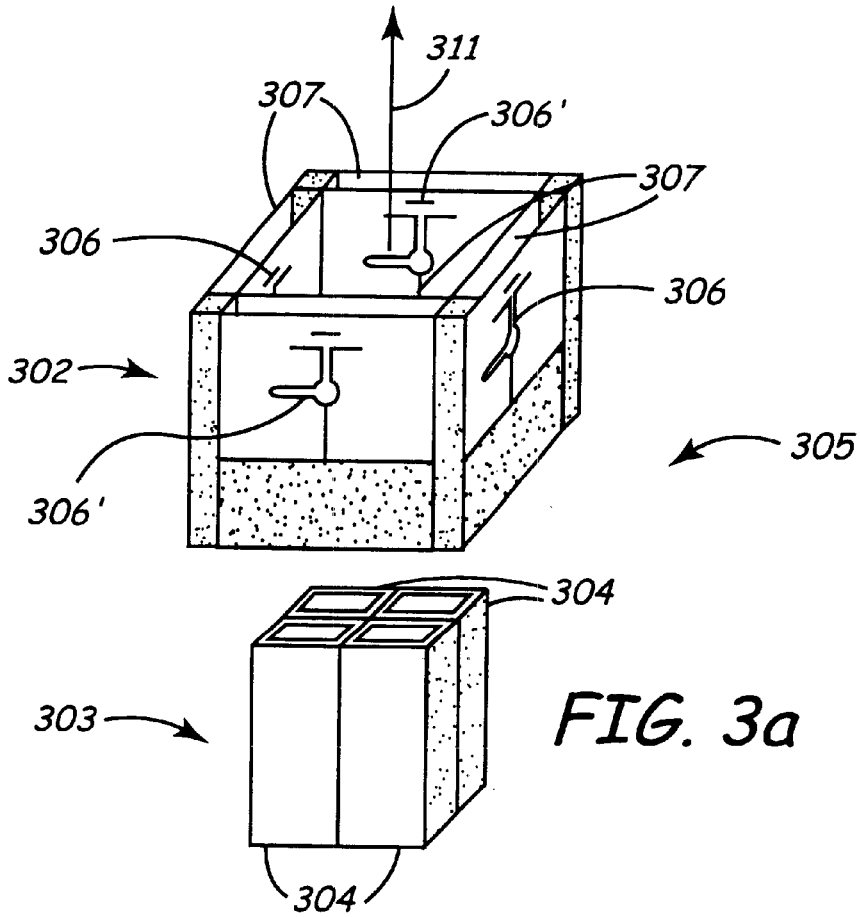
FIG. 3*a* is an isometric view of a single unit cell using quasi-Yagi and square waveguide radiators.
Figure 3B:
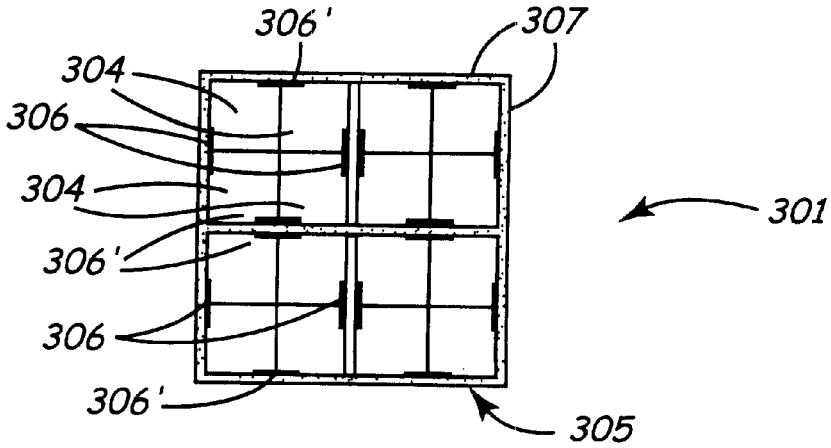
FIG. 3*b* is a top view of a three-band wideband phase sub-array comprising four unit cells of FIG. 3*a;*

FIG. 3*a* shows a single unit cell 305 used in forming a phased array antenna 200 of the present invention. FIG. 3*b* illustrates a wideband sub-array 301 comprising four unit cells 305 that may cover three or more of the SATCOM bands of the table depending on the bandwidth of the chosen radiating elements. An isometric view of a single unit cell 305 is shown in FIG. 3*a* and a top view of the sub-array 301 is shown in FIG. 3*b*.

In the unit cell 305 in FIG. 3*a* low frequency SATCOM band coverage, such as 11/12 and 20 GHz, is provided by end-fire radiating elements 306 and 306' etched on four double-sided printed circuit board 307 walls positioned with pairs of walls parallel to each other and parallel pairs of walls perpendicular to each other to form a low frequency band radiating assembly 302. Each radiating element in FIG. 3*a* is shown as quasi-Yagi end-fire radiating elements 306 and 306'. The low frequency assembly 302 has quasi-Yagi radiating element 306 and 306' on each inner printed circuit board 307 surface with a radiation direction out on open end as shown by arrow 311. The printed circuit boards 307 of the unit cell 305 may also have the quasi-Yagi radiating elements 306 and 306' of an adjacent unit cell 305 on the outer circuit board 307 surfaces as shown in FIG. 3*b*. The unit cell 305 may share the quasi-Yagi radiating elements 306 and 306' with adjacent unit cells with only one element disposed between the unit cells 305. This concept is similar to the printed quasi-Yagi antenna research of Qian, et al. of UCLA and described in "A Uniplanar Quasi-Yagi Antenna with Wide Bandwidth and Low Mutual Coupling Characteristics", IEEE Antennas and Propagation Society 1999 AP-S International Symposium Digest, Orlando Fla., July, 1999.

In each unit cell 305, open-ended square waveguides 304 form a high frequency band radiating assembly 303 positioned at an open input end of the low frequency assembly 302 as shown in FIG. 3*a*. The waveguides 304 are used for single band coverage of one of the high frequency SATCOM bands, such as 30 and 40 GHz, as shown in the table above and are described in greater detail in the following paragraphs.

FIG. 3*b* shows a top view of the sub-array 301 comprising four unit cells 305. Four unit cells 305 are shown in the sub array 301 of FIG. 3*b* but any number may be used. The quasi-Yagi end-fire radiating elements 306 and 306' are located on the walls of the printed circuit boards 307 as described above. The printed circuit boards 307 form the walls of adjacent low frequency assemblies 302 in an egg crate fashion. Circular polarization (CP), which is required by the SATCOM systems, may be achieved by driving vertical polarized and horizontal polarized printed elements in phase quadrature. In a single unit cell 305, vertical Yagis 306 are driven with one phase and horizontal Yagis 306' are driven in phase quadrature to achieve circular polarization. Good axial ratio performance is realized even though the electrical phase centers of the vertical polarization 306 and horizontal polarization radiating elements 306' are displaced from one another as shown in FIG. 3*a*. Further improvement in axial ratio may be possible using phase shift compensation as part of a beam steering algorithm of the phased array. Additionally, two separate polarizations to realize a dual linear polarization antenna are also possible.

Figure 4A:
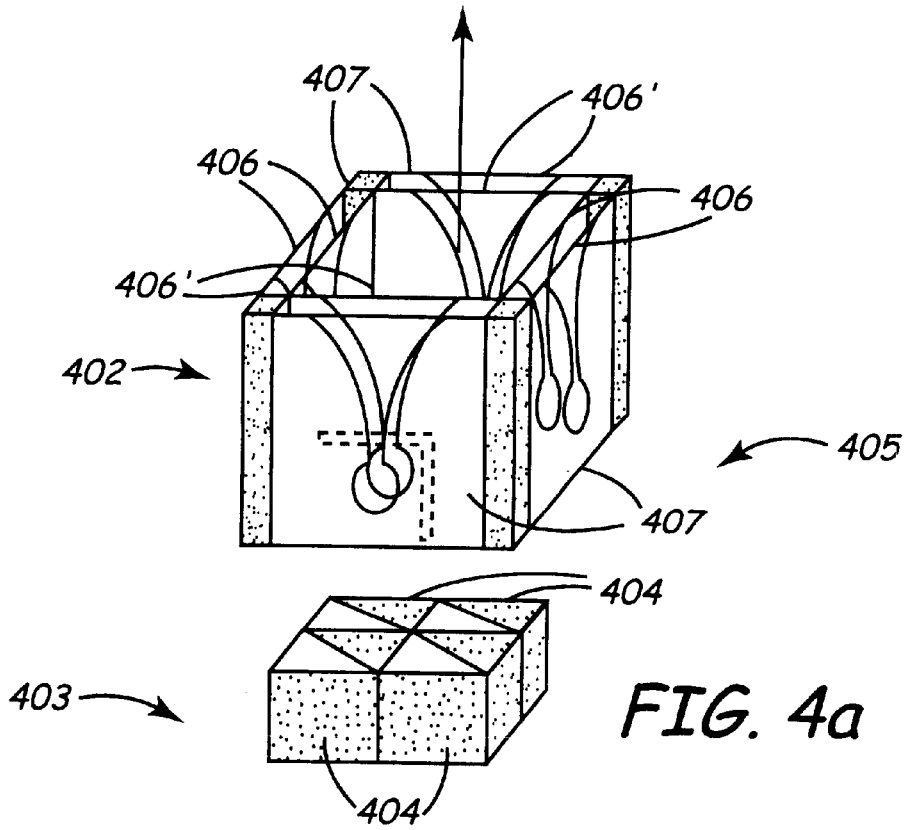
FIG. 4*a* is an isometric view of an alternate embodiment four-band wideband unit cell for use in the present invention.
Figure 4B:
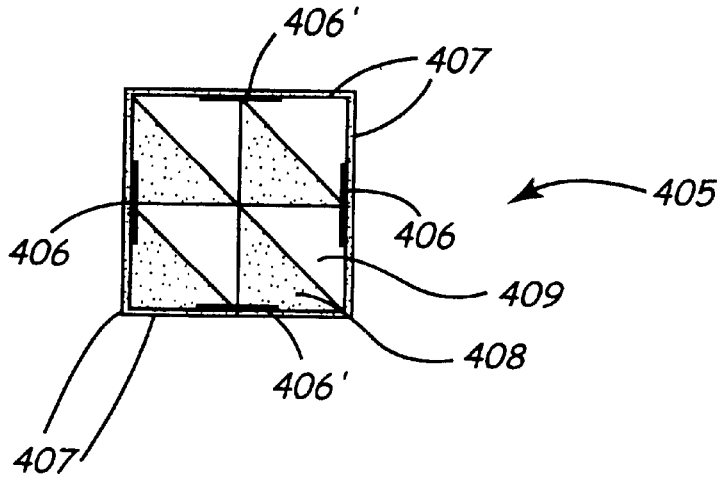
FIG. 4*b* is a top view of the alternate embodiment unit cell of FIG. 4*a;*

FIG. 4*a* and FIG. 4*b* illustrate an alternate embodiment wideband unit cell 405 for use in the present invention that may cover four or more of the SATCOM bands of the table. The number of bands covered is again dependent on the choice of radiating elements. FIG. 4*a* shows an alternate embodiment of a low frequency radiating assembly 402 incorporating notch end-fire radiating elements 406 and 406' and an alternate embodiment of a high frequency radiating assembly 403 with triangular waveguide elements 404. Vivaldi notch radiators are shown in FIG. 4*a* but other types of notch radiators known in the art may be used. For example, an antipodal notch radiator that offers sufficient broadband coverage to cover all of the low frequency bands may be used. Waveguide elements 404, comprising eight triangular waveguides, provide dual band coverage of the high frequency SATCOM bands and are described in greater detail in the paragraphs below.

In FIG. 4*a*, notch radiating elements 406 and 406' are etched on four double-sided printed circuit board 407 walls positioned with pairs of walls parallel to each other and parallel pairs of walls perpendicular to each other to form the low frequency band radiating assembly 402. The notch radiators 406 and 406' are again shown as printed circuits on the inner and outer wall surfaces of printed circuit boards 407 of the low frequency assembly 402. The outer wall notch radiating elements 406 and 406' form the radiating elements for adjacent unit cells 405 as in FIG. 3*b*. The unit cell 405 may share the notch radiating elements 406 and 406' with adjacent unit cells with only one element disposed between the unit cells 405. This concept is similar to the Vivaldi notch work of Schaubert et al. and described in the paper "Wideband Vivaldi Arrays for Large Aperture Antennas" from Perspectives on Radio Astronomy—Technology for Large Antenna Arrays, Netherlands Foundation for Research in Astronomy, 1999.

A top view of the notch unit cell 405 incorporating the triangular waveguide elements 404 is shown in FIG. 4*b*. In the single unit cell 405, vertical notches 406 are driven with one phase and horizontal notches 406' are driven in phase quadrature to achieve circular polarization as with the quasi-Yagi radiating elements 306 and 306'. Two separate polarizations are again possible to realize a dual linear polarization antenna. Any number of notch unit cells 405 may be combined in a sub-array similar to that shown in FIG. 3*b*.

The notch unit cell 405 of FIGS. 4*a* and 4*b* is the preferred radiating element system over the quasi-Yagi unit cell 305 for the following reasons: the thickness of the notch radiators 406 and 406' are electrically thin (0.005 to 0.03 $\lambda_o$), the width of the notch radiators 406 and 406' may be small since the 11- and 20-GHz band requirements are narrow band relative to the realizable bandwidth, and linear arrays of radiators may be fabricated on single printed circuit boards 407 and may be assembled in a two-dimensional grid to form a planar array. These attributes allow a volume between the notch radiators 406 and 406' printed circuit board walls 407 to be partially occupied by the high frequency radiating assembly 403 waveguides 404. The high frequency band radiating assembly 403 is shown below the low frequency assembly 402 in FIG. 4*a* for clarity. In an actual unit cell 405, the high frequency assembly 403 waveguide open end may be located even with or protrude into the low frequency assembly 402.

A phased array antenna 200 with coverage of the low frequency bands and both the 30- and 44-GHz high frequency bands is preferable to reduce size and maintain a low vehicle profile. This is accomplished by integrating two isosceles triangular waveguides to form a single rigid square-shaped waveguide 404 of FIGS. 4*a* and 4*b* that may be used instead of the single frequency TEM waveguide 304 of FIGS. 3*a* and 3*b*. A triangular waveguide is described in *Electromagnetic Waves*, S. A. Schelkunoff, D. Van Norstrand Co., Inc, NY, N.Y. 1943. A 44-GHz portion 408 may be a free-space loaded waveguide while a 30-GHz portion 409 may be a dielectric loaded waveguide within the 11- and 20-GHz array of FIGS. 4*a* and 4*b* to arrive at a dual band high frequency radiating assembly 403. The 44-GHz waveguide 408 and the 30-GHz waveguide 409 may also be separate waveguides located together. Dielectric loading may be used to lower the operating frequency of a waveguide. Dielectric loading may not be required for a photonic band gap (PBG) waveguide, described below, since the PBG material lowers the cutoff frequency of the waveguide. Waveguide 408 and 409 may both be PBG waveguides with the operating frequency adjusted by the tunable PBG material to obtain multiband coverage.

The quasi-Yagi 306 and 306' radiating element assembly of FIG. 3*a* may be used with the waveguides 404 of FIG. 4*a* to form a quad band unit cell and sub-array. The notch 406 and 406' radiating assembly may be used with the waveguides 304 of FIG. 3*a* to form a three-band unit cell and sub-array. An integrated aperture sub-array 301 as shown in FIG. 3*b* may incorporate either 30-GHz or 44-GHz square TEM waveguide elements 304. In a complete phased array antenna 200, sub-arrays 301 may have unit cells 305 that contain 44-GHz apertures 304, while other sub-arrays 301 may have 30-GHz apertures 304.

In the unit cells 305 and 405, radiated circular polarized waves generated by the waveguides 304 and 404 radiate into a slotted, metallic square waveguide created by the quasi-Yagi 306 and 306' and notch 406 and 406' radiator assembly printed circuit boards 307 and 407. A guided wave mode translation occurs at this junction. The CP nature of the 30- and 44-GHz waves is retained due to mechanical symmetry. First-order one-dimensional FFT analysis of a continuous aperture with thin periodic gaps along its length shows that gaps in the 30- and 44-GHz arrays due to the low frequency printed circuits substrates 307 and 407 have only a minor effect on array performance.

Beam steering of the phased array antenna 200 of the present invention may be realized by a variety of phase shift methods in the unit cells 305 and 405 for the high frequency band waveguides 304 and 404 and low frequency bands printed circuit radiating elements 306, 306', 406, and 406'. Traditional radio frequency (RF) circuit phase shift technologies may be used or an optical true time delay network with fiber optic connections from the beam steering network to either the sub-array or radiating element level.

In a classic beam forming network approach for a phased array antenna 100 of FIG. 1*a*, a phase shifting function may be implemented in a variety of ways known in the art. One method is the phase shifters 115 shown in FIGS. 1*b* and 1*c*.

Figure 5:
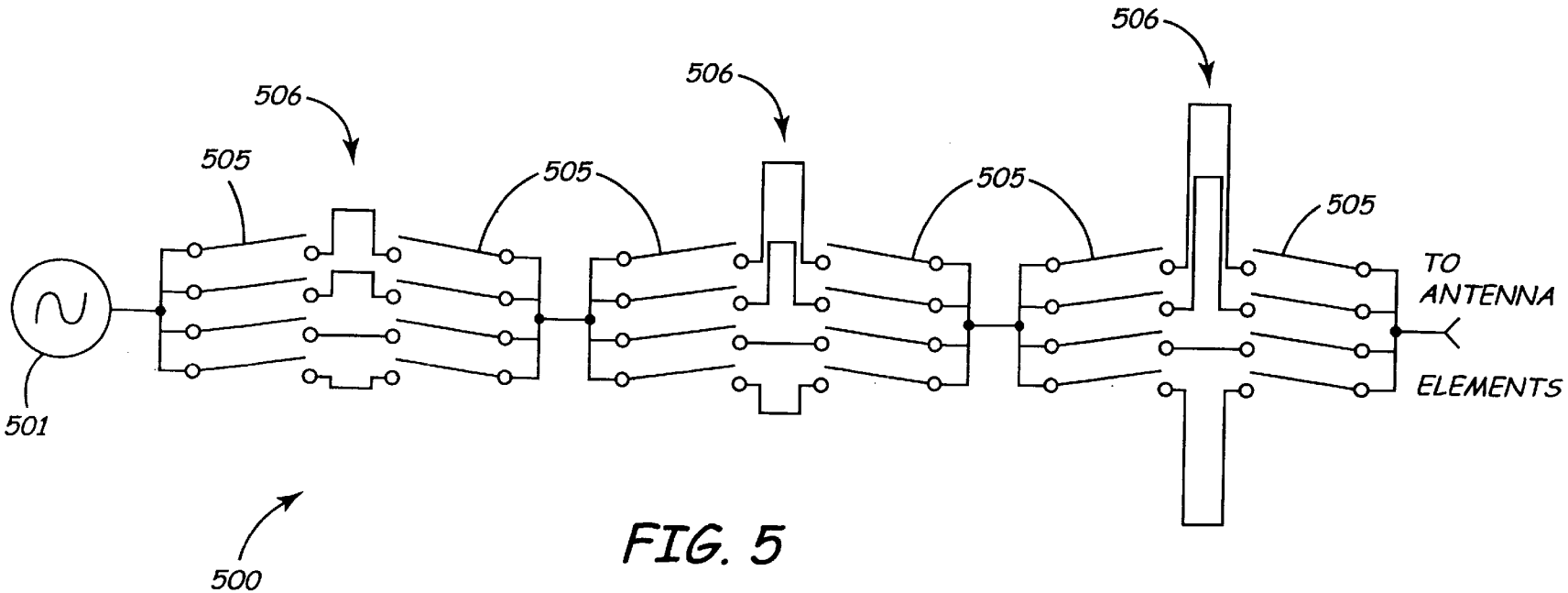
FIG. 5 is a schematic diagram of a MEMS switch-based true time delay device phase shifter for beam steering the phased array antenna of the present invention.
Figure 6:
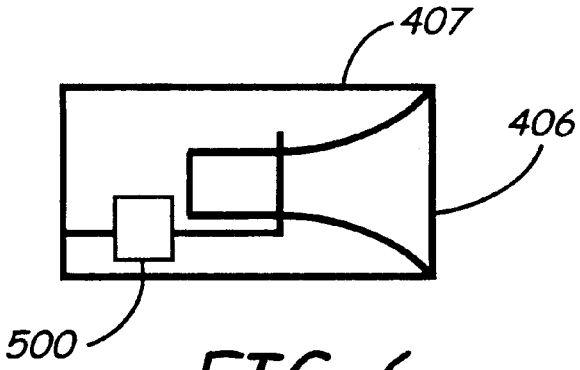
FIG. 6 illustrates a phase shifter mounted on a printed circuit board with a notch radiating element of FIG. 4*a;*

A preferred method of phase shifting in the present invention for the printed circuit board radiating elements 306, 306', 406, and 406' is to use a broadband RF MEMS switch-based true time delay (TTD) devices such as disclosed in U.S. Pat. No. 6,281,838 incorporated herein by reference in its entirety. The RF signal from a signal source 501 is passed through the RF MEMS phase shifter 500, shown in FIG. 5, and then to the end-fire radiation elements 306, 306', 406, and 406' of FIGS. 3*a* and 4*a*. The phase shifting network 500 may be implemented as shown in FIG. 5, utilizing only the MEMS phase shifter circuitry, or with contemporary PHEMT or other new semiconductor transmit/receive (T/R) module monolithic microwave integrated circuits (MMIC) since the MEMS switch process is compatible these devices. MEMS switches 505 are used to switch delay lines 506 in response to control signals to steer the phased array antenna 200 beam. MEMS switches 505 are the preferred way to switch the TTD phase shifter 500 but other switches know in the art may be used. A TTD phase shifter 500 may be mounted on the same circuit board as the radiating elements 306, 306', 406, and 406' as shown in FIG. 6 with notch radiating element 406 being shown. The TTD phase shifter 500 may be a flip chip or otherwise mounted to the printed circuit board 407. PHEMT or other type T/R modules (not shown) may also be included on the circuit board as separate chips. Other phase shifters known in the art such as a PIN diode phase shifter may be substituted for the TTD phase shifter 500. The TTD device phase shifting network 500 may also be included as part of a constrained feed manifold 201 of FIG. 2.

Figure 7:
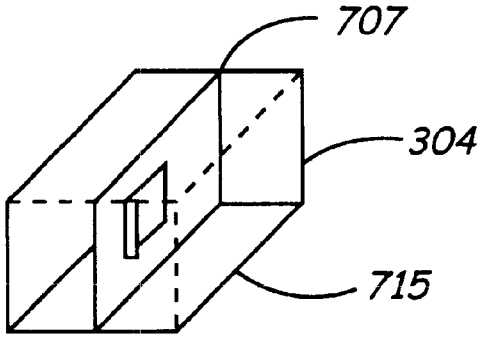
FIG. 7 is a drawing showing how a phase shifter may be mounted in a waveguide of FIG. 3*a* and FIG. 3*b;*

Phase shifters for the rectangular waveguide 304 and triangular waveguide 404 for the high frequency SATCOM bands may be implemented by techniques known in the art. FIG. 7 shows a printed circuit board 707 suspended in the center of waveguide 304 with a phase shifter 715 mounted on the printed circuit board 707. The printed circuit board 707 has a waveguide to microstrip transition (not shown). The phase shifter 715 may be PIN diode, MMIC, or MEMS phase shifter.

Figure 8:
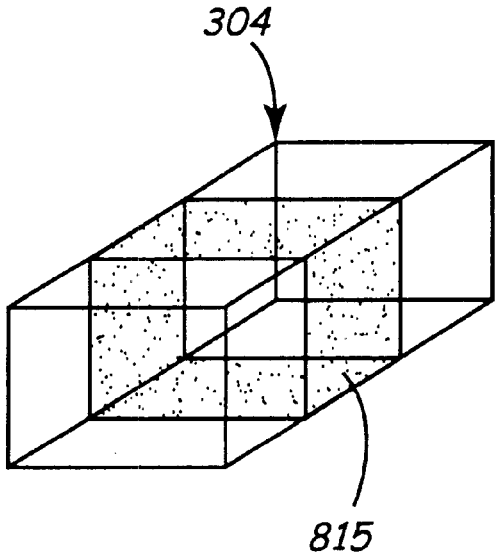
FIG. 8 is a drawing of a bulk waveguide phase shifter.

An alternate waveguide phase shifter is shown in FIG. 8. A ferroelectric or ferromagnetic material loaded phase shifter is formed by placing a band 815 of material on inner walls of waveguide 304 to form a bulk waveguide shifter known in the art.

Figure 9:
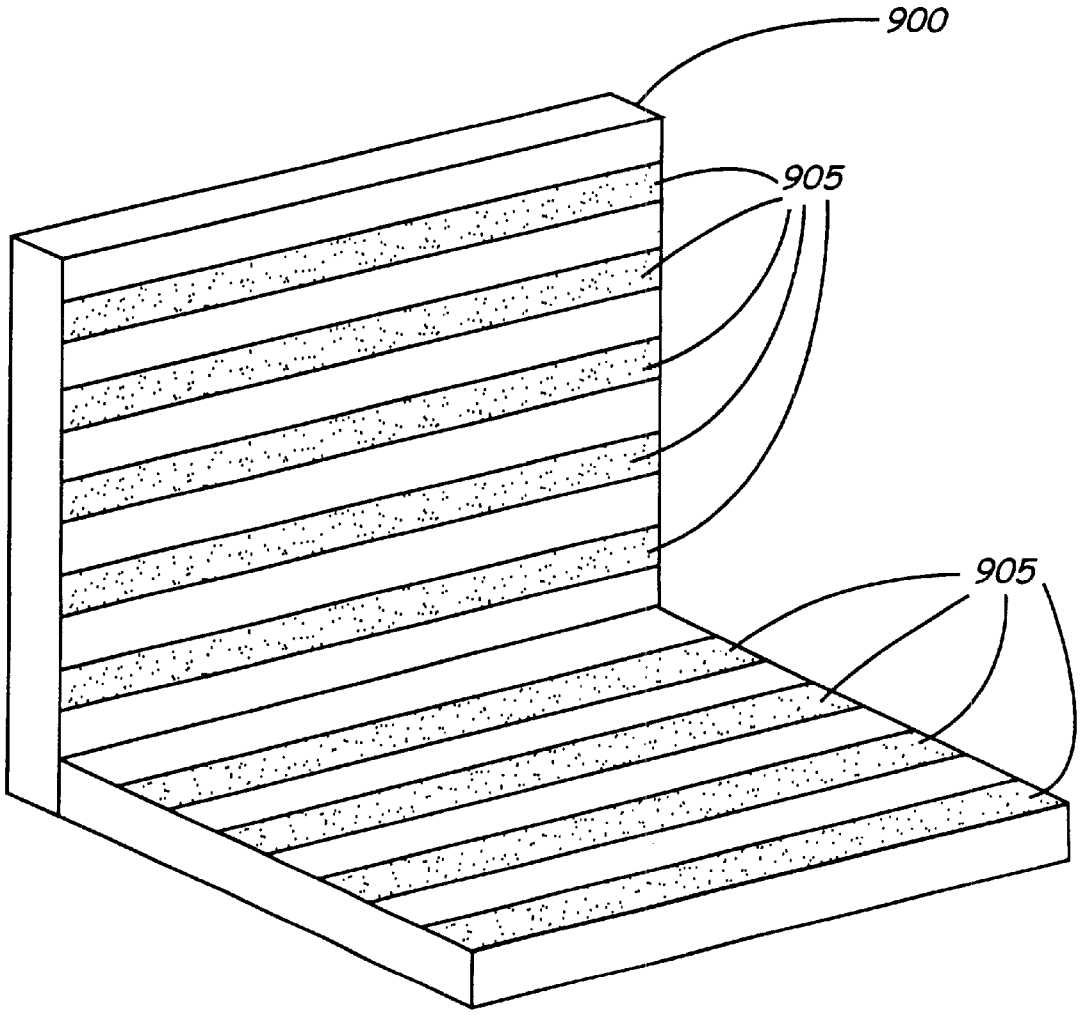
FIG. 9 is a diagram showing a preferred phase shifter using photonic band gap materials for use in the present invention.

A preferred phase shifting method for waveguides 304 and 404 to steer the antenna 200 beam is by means of tunable photonic: band gap (PBG) structures. Tunable PBG phase shifting material is embedded with the waveguide assemblies 304 and 404. Photonic band gap structures are periodic dielectric structures that forbid propagation of electromagnetic waves in a certain frequency range. Phase shifting is obtained by modulating the surface impedance of the PBG material on the waveguide walls. Several approaches to tunable PBG material are currently being studied including ferroelectric material based substrates, ferromagnetic based substrates, varactor diode loaded PBG substrates, or MEMS based PBG structures. FIG. 9 shows an embodiment of a tunable PBG material phase shifting waveguide 900 for beam forming. For simplicity, only two walls of the waveguide 900 are shown in FIG. 9. Linear polarized phase shifting is realized when two narrow walls of the waveguide are lined with PBG material. Circular polarization may be obtained by differential phase shifting of orthogonal radiating E field components within the waveguide 900. Stripe high impedance planes 905 on all four walls support two orthogonal TEM waves in FIG. 9. Phase shifting is obtained by means of the tunable PBG material in the stripe high impedance planes 905 located on the walls of the waveguide 900. Alternately, the phase shift function may be obtained with MEMS switch-based broadband true time delay (TDD) devices.

The unit cells 305 and 405 that make up the phased array antenna 200 of the present invention may be fed with a variety of methods. Constrained feed manifolds may be used for the waveguides 304 and 404 and the end-fire radiating elements 306, 306', 406, and 406' as shown in FIG. 1*c*. However, a complicated feed manifold is required with a constrained feed for electrically large arrays. For example, a 20×20-element array with 400 total elements requires a 400-way transmission line power-dividing network. If two simultaneous polarizations are required, then two such manifolds are needed. The preferred method is to use space feed as shown in FIG. 2*a* with the feed horn 220. Space feed may also be used as shown in FIGS. 1*a* and 2*a*. The space feed method may be used for the waveguide elements 304 and 404 and a constrained feed for the end-fire radiating elements 306, 306', 406, and 406'. The space feed method may be used for both the waveguide elements and the end-fire radiating elements.

Figure 10:
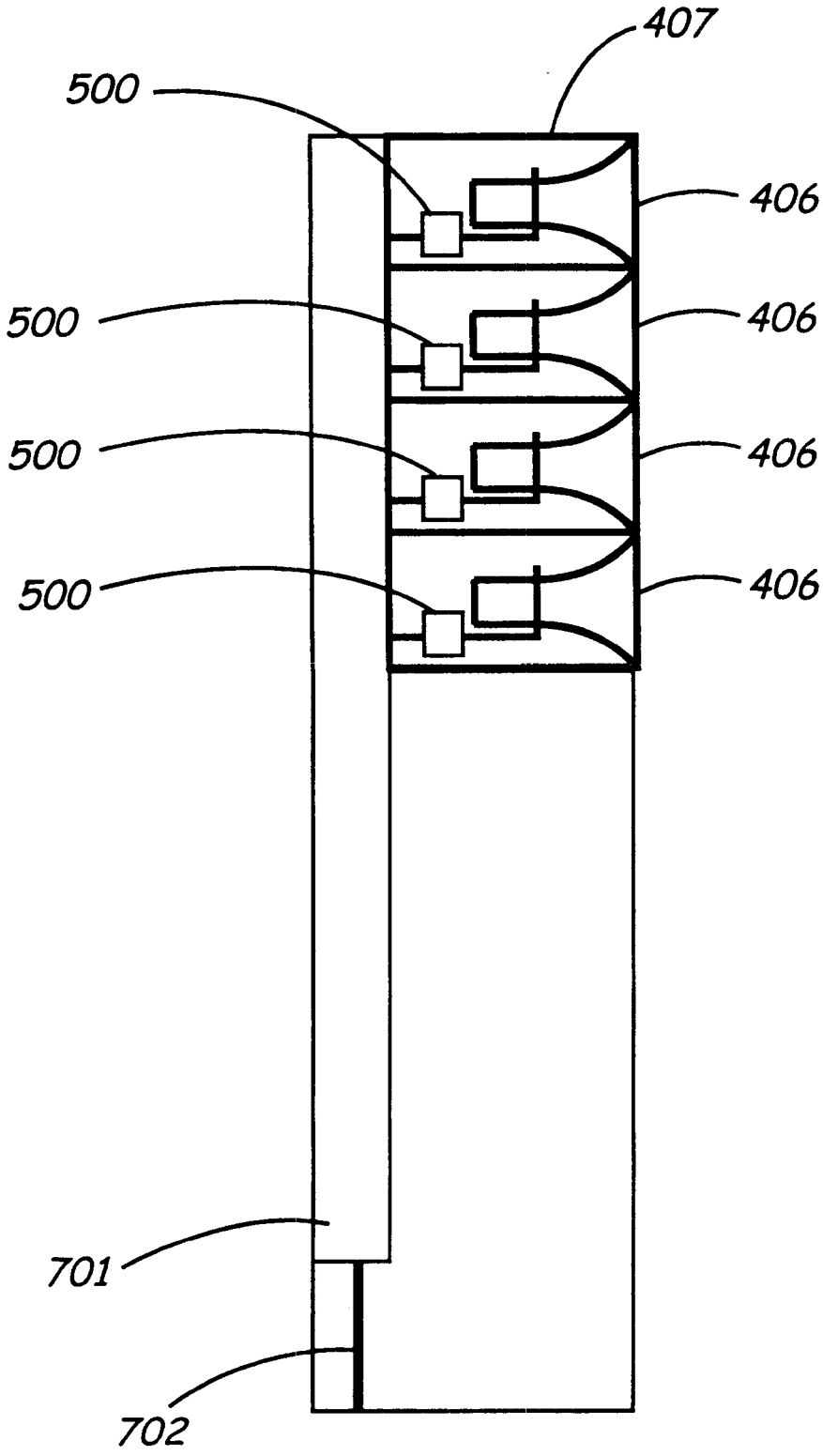
FIG. 10 illustrates how a constrained feed may be used with a notch radiator array.

FIG. 10 illustrates how a portion of a constrained feed may be implemented with a linear array of notch radiators 406. Shown in FIG. 10 are multiple notch radiators 406 and phase shifters 500 for the vertical polarized radiating elements on a common printed circuit board 407. Printed circuit board 407 in FIG. 10 is an extension of the circuit boards 407 in FIGS. 4*a* and 4*b* with additional notch radiators 406 added. Another printed circuit board 407 similar to that in FIG. 10 with notch radiators 406' of FIGS. 4*a* and 4*b* for horizontal polarization is placed perpendicular to the vertical polarization circuit board 407 with notch radiators 406 to form the egg crate array panel 202 of FIG. 2*a*. The array elements are connected to a microstrip or stripline feed manifold 701 on both the horizontal polarization printed circuit board and the vertical polarization circuit board. All the vertical board feed manifolds 701 are connected together with connections 702 to a common vertical feed manifold (not shown) positioned horizontally along the bottom or top of array 202 in FIG. 2*a*. Similarly, the horizontal board feed manifolds 701 are connected together to a common horizontal feed manifold (not shown) positioned vertically on the left or right side of array 202 in FIG. 2. The manifolds 701 are then connected to the RF source 110 to complete the feed manifold assembly 201 in FIG. 2*a*. Feed manifold 201 may also contain phase shifters for two-dimensional electronic scanning of the phased array antenna 200.

Figure 11:
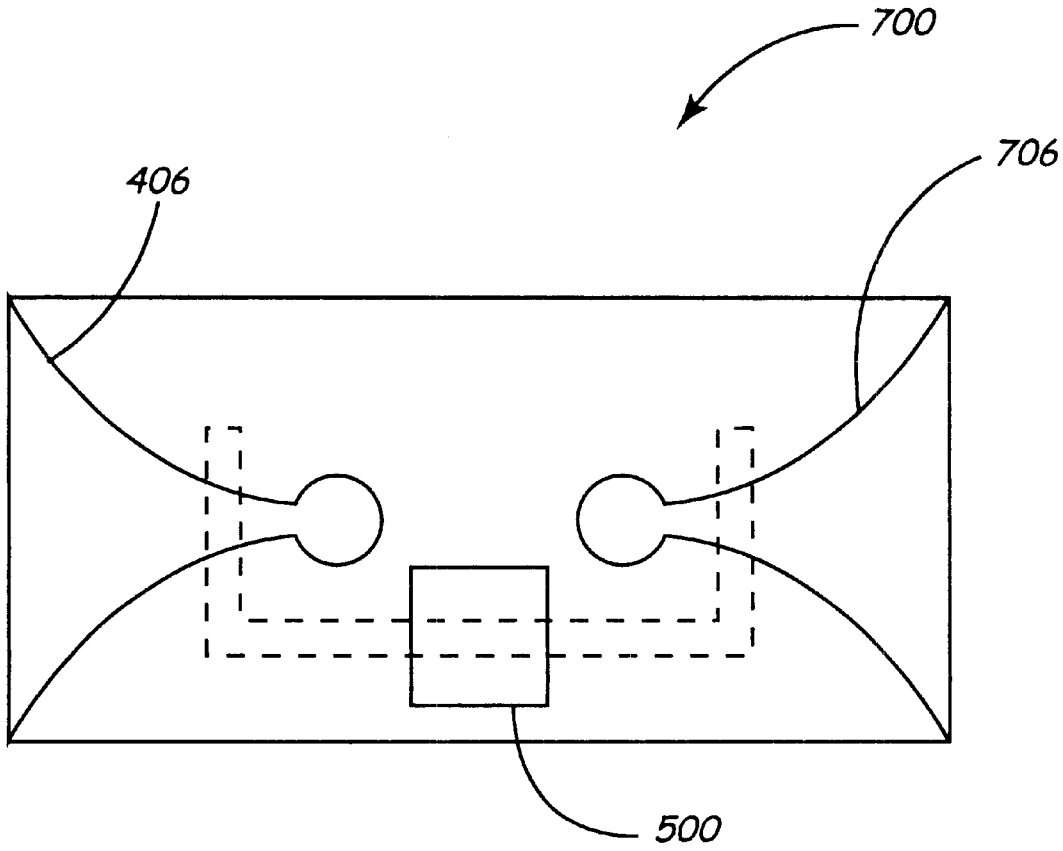
FIG. 11 illustrates a single receive/transmit element with back-to-back notches for use in a space feed notch array.

One method to feed the low frequency band of the phased array antenna 200 is a space feed with a space feed notch array. Other radiation elements as previously mentioned may also be used. FIG. 11 illustrates a single receive/transmit (primary/secondary) element 700 comprising back-to-back notches for use in the space feed notch array. A receive notch 706 accepts a incoming signal from the feed horn 220. Variable lengths of microstrip, slotline, or stripline transmission lines within the element 700 collimate the incoming wave front. The output notch 406 is the notch 406 or 406' in FIG. 4*a*. The phased array antenna 200 may be electronically scanned by means of flip-chip mounted MEMS true time delay devices (TTD) 500 shown in FIG. 5 mounted on element 700. With the TTD device 500 associated with each notch radiating element, it is possible to have two independent orthogonal polarized beams, each with independent beam steering control. Additionally, the TTD device 500 and the notch radiators 406 and 706 are inherently broad band, thus enabling broad band array performance.

In the space feed configuration, the feed horn 220 of FIG. 2*a* may be a dual polarized waveguide horn with an orthomode transducer (OMT) to simultaneously generate two senses of linear polarization at the same frequency. If different frequencies are required, then the amount of spherical wave front correction to achieve collimation is a function of frequency. The typical bandwidth of a space fed phased array scanned 60° off boresight is two times the aperture beam width. Circular polarization is possible with this array architecture with the following implementations: circularly polarized waveguide feeds with fixed vertical and horizontal phase shifts within the lens assembly, dual circularly polarized feeds with fixed vertical and horizontal phase shifts within the lens assembly, and dual linear feeds with ±90° relative phase shift between the vertical and horizontally polarized signals either within the lens assembly or at the feed.

Spatial power combining techniques are known in the art and are disclosed in U.S. Pat. No. 5,736,908. Within a spatial power-combining amplifier, amplifying devices are located in each array element 105 of the phased array antenna 100 of FIG. 1*a*. The feed horn 120 again drives the array and provides power to the amplifier elements; the amplifier elements amplify the input and radiate the amplified signal to a collector horn (not shown). The collector horn may be eliminated and the assembly used as a phased array antenna with the amplifier elements built in. The unit cells 305 and 405 of the present invention may be used in a multiband spatial power combiner as well as in a phased array antenna. The major difference a spatial power combiner and a phased array antenna is the addition of the power amplifier devices and the collector horn in the spatial power combiner and phase shifting circuitry in the phased array antenna to steer the beam.

It is believed that the multi-band phased array SATCOM antenna of the present invention and many of its attendant advantages will be understood by the foregoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A multiband phased array antenna for radiating low frequency band signals and high frequency band signals said multiband phased array antenna formed from a plurality of unit cells each of said unit cells comprising:

a low frequency assembly comprising:

four walls disposed with perpendicular pairs of parallel walls thereby forming a square configuration with an open input end and an open radiating end; and end-fire radiating elements disposed on the four walls and radiating out the radiating end; and a high frequency assembly comprising four high frequency square waveguides said four high frequency square waveguides sized and arranged in a square to radiate into the input end of the low frequency assembly square waveguide.

2. The multiband phased array antenna of claim 1 wherein:

a junction between the low frequency assembly square waveguide and the high frequency assembly creates a guided wave mode transition.

3. The multiband phased array antenna of claim 1 wherein the end-fire radiating elements comprise quasi-Yagi radiators.

4. The multiband phased array antenna of claim 1 wherein the end-fire radiating elements comprise notch radiators.

5. The multiband phased array antenna of claim 1 further comprising:

horizontal end-fire radiating elements disposed on horizontal walls of the low frequency assembly to produce a horizontal polarized signal; and vertical end-fire radiating elements disposed on the vertical walls of the low frequency assembly to produce a vertical polarized signal.

6. The multiband phased array of claim 5 wherein the vertical end-fire radiating elements and the horizontal end-fire radiating elements are fed in phase quadrature to produce a circular polarized signal.

7. The multiband phased array antenna of claim 1 wherein the four high frequency square waveguides further comprise pairs of triangular waveguides disposed together for radiating and receiving two high frequency band signals.

8. The multiband phased array antenna of claim 1 further comprising a plurality of phase shifters for steering a low frequency beam and a high frequency beam.

9. The multiband phased array antenna of claim 8 wherein the low frequency beam steering phase shifter comprises a true time delay phase shifter connected between the RF signal source and the end-fire radiating elements.

10. The multiband phased array of claim 8 wherein the high frequency beam steering phase shifter comprises a tunable photonic band gap material waveguide having tunable photonic band gap material located on walls of said waveguide.

11. A multiband phased array antenna for low frequency band signals and high frequency band signals comprising:

a plurality of unit cells disposed with said unit cells adjacent to each other wherein each unit cell further comprises:

four walls disposed with perpendicular pairs of parallel walls to form a square configuration having an open input end and an open radiating end;

end-fire radiating elements disposed on surfaces of the four walls and radiating and receiving low frequency band signals out the radiating end;

at least four high frequency square waveguide radiating elements disposed together said high frequency square waveguide radiating elements having open ends radiating and receiving high frequency band signals into the input end and out the radiating end of said square configuration; and a plurality of phase shifters connected to unit cells to shift the phase of the low frequency band signals and the high frequency band signals to steer a beam of the phased array antenna.

12. The multiband phased array antenna of claim 11 wherein the end-fire radiating elements comprise quasi-Yagi radiators.

13. The multiband phased array antenna of claim 11 wherein the end-fire radiating elements comprise notch radiators.

14. The multiband phased array antenna of claim 11 further comprising:

horizontal end-fire radiating elements disposed on horizontal walls to produce a horizontal polarized signal; and vertical end-fire radiating elements disposed on the vertical walls to produce a vertical polarized signal.

15. The multiband phased array of claim 14 wherein the vertical end-fire radiating elements and the horizontal end-fire radiating elements are fed in phase quadrature to produce a circular polarized signal.

16. The multiband phased array antenna of claim 11 wherein the four high frequency square waveguide radiating elements further comprise pairs of triangular waveguides disposed together for radiating and receiving two high frequency band signals.

17. The multiband phased array antenna of claim 11 wherein the plurality of phase shifters comprises a true time delay phase shifter connected between an RF signal source and the end-fire radiating elements for phase shifting the low frequency signals.

18. The multiband phased array antenna of claim 11 wherein the plurality of phase shifters comprises a tunable photonic band gap material in the four high frequency square waveguide radiating element for phase shifting the high frequency signals.

19. A multiband unit cell comprising:

four walls disposed with perpendicular pairs of parallel walls to form a square configuration having an open input end and an open radiating end;

notch radiating elements disposed on surfaces of the four walls and radiating and receiving low frequency band signals out the radiating end; and at least four high frequency square waveguide radiating elements disposed together said high frequency square waveguide radiating elements having open ends radiating and receiving high frequency band signals into the input end and out the radiating end of said square configuration.

20. The multiband unit cell of claim 19 wherein the four high frequency square waveguide radiating elements further comprise pairs of triangular waveguides disposed together for radiating and receiving two high frequency band signals.

* * * * *